United States Patent [19]

Motai

[11] 4,127,686

[45] Nov. 28, 1978

[54] PROCESS FOR TREATING WOOD

[75] Inventor: Takeji Motai, Chofu, Japan

[73] Assignee: Shin-Asahigawa Co., Ltd., Japan

[21] Appl. No.: 754,266

[22] Filed: Dec. 27, 1976

[30] Foreign Application Priority Data

May 12, 1976 [JP] Japan ..... 51-53336

[51] Int. Cl.[2] ..... B27K 3/02; B27K 3/34; B05D 7/06

[52] U.S. Cl. ..... 427/351; 427/297; 427/372 R; 427/440

[58] Field of Search ..... 21/7; 427/297, 351, 427/372 R, 440

[56] References Cited

U.S. PATENT DOCUMENTS

| | | | |
|---|---|---|---|
| 76,757 | 4/1868 | Heineman | 427/440 |
| 1,328,656 | 1/1920 | Fish | 427/297 |
| 3,317,375 | 5/1967 | Molinet et al. | 427/440 |
| 3,342,629 | 9/1967 | Martin | 21/7 |
| 3,877,976 | 4/1975 | Olson et al. | 21/7 |

*Primary Examiner*—Michael R. Lusignan

*Attorney, Agent, or Firm*—Wenderoth, Lind & Ponack

[57] ABSTRACT

A process for treating wood which process comprises boiling the wood with a solution containing a surface active agent and an alkali, shifting the boiled wood to a pressure boiler, permeating the surface active agent and dilute alkali solution forceably into the wood under the conditions of pressure and heating, dehydrating it by applying reduced pressure to the wood, air drying or kiln drying the wood so treated.

6 Claims, No Drawings

PROCESS FOR TREATING WOOD

SUMMARY OF THE INVENTION

The present invention relates to a process for treating wood to eliminate defects of the wood.

Wood is extensively used in modern society in particular for housing materials and furniture. However, the woods tend to contain defects such as warp, spiral grain, crooks, breaks, stains, rot, and for the housing industry, furniture industry and also engaged in using wood, such defects constitute an extremely serious problem.

Wood is different from plastics and metals, in a variety of ways as will be mentioned in the following; namely, (1) difference in materials such as heartwood, sapwood, defective wood;

(2) difference in wood structure ray and components;

(3) difference in thickness, width and length;

(4) difference in physical processing machinability when quarter sawned, plain sawed or intermediately sawed;

(5) non-uniformity of water content of wood itself;

(6) difference in drying conditions, maintenance conditions and conditions of use; whereby various defects due to various causes as mentioned in the foregoing, result in a difference in quality. The elimination of this wide and complex range of defects is an extremely important world-wide problem.

DETAILED DESCRIPTION OF THE INVENTION

According to the present invention, there is provided a process for treating wood which process comprises boiling the wood with a solution containing a surface active agent and an alkali, shifting the boiled wood to a pressure boiler, permeating the surface active agent and dilute alkali solution forceably into the wood under the conditions of pressure and heating, dehydrating it by applying reduced pressure to the wood, and air drying or kiln drying the wood so treated.

In the present invention, the wood is preferably softened without destroying the structure of the wood, converting the various substances in the wood, which substances are regarded as the cause of the defects, into an extremely soluble condition, separating resin or hemicellulose which tends to dissolve in hot water solution by action of the surface active agent, permeating the surface active agent and dilute alkali solution into every part of the wood ray by applying pressure and heating in the presence of the surface active agent and dilute alkali solution in the pressure boiler, dispersing the solution in the wood, dissolving and separating the wastes such as resin, lignin, hemicellulose accumulated in the wood components and vessels, tracheids, pits lumina which are regarded as the main cause of defects of the wood, forceably separating them by reduced pressure, homogenizing the unhomogeneous composition of the wood which is regarded as the main cause of the defects, eliminating and correcting phenomenon such as partial surplus of the wood ray component and maldistribution causing differences in wood quality, and producing wood components of stable quality substantially free from the above defects. Also, it is possible to transfer the wood immediately from the pressure boiler to a kiln drying chamber to dry it below 10% moisture content, and in this case shortening the drying time which generally take over about 9 days.

In case of species having a relatively small number of defects (Japan cedar, silver fir and Japanese cypress), the boiling time by the surface active agent solution can be shortened by about ½, and the concentration of the surface active agent solution and dilute alkali solution can be reduced by about ½ and also the pressure and heating conditions in the dilute alkali solution can be lowered to 2.0 kg/cm$^2$ and 120° C. and 2 hours and yet the same object can be achieved.

Furthermore, the surface active agent solution in the boiling tank can be used repeatedly by adjusting the concentration thereof, thus ensuring economy in the treatment of the invention.

There are cases where the conditions of treatment such as species, moisture content, dimensions are required to be changed to a certain degree, but except for special woods for precision utilization, in the general, the sufficiency of treatment can be secured by the foregoing treating method.

However, there is a relationship between the moisture content of the wood to be treated and the boiling conditions of the wood, for instance:

(1) In the wood whose moisture content is below 30%, unless the boiling treatment is in the presence of a surface active agent whose concentration is about 0.5%, it is difficult to remove the defects of the wood even if the treatment is carried out for sufficient time in the next step under the pressure and heating conditions in the presence of the surface active agent and the dilute alkali solution.

(2) In the wood whose moisture content is above 30% and below 60%, the concentration of the surface active agent can be set lower, 0.1% to 0.3%. In this case too, unless the wood is boiled in the presence of the solution containing the surface active agent, the irregularity of the wood is generated even if the pressure and heating treatment in the presence of the surface active agent and the dilute alkali solution is employed in the next step, and it is difficult to eliminate the defects of the wood completely.

(3) In the wood whose moisture content is above 60%, the concentration of aqueous solution of the surface active agent in the boiling tank may be extremely small i.e. 0.01%.

When the process of the present invention is applied to larch, separation of resin, spiral grains, crooks, warps and breaks, which are drawbacks of the larch, can be totally eliminated, and its excellent features such as strength, durability, beauty of grain can be utilized, and moreover its advantageous points such as abundant accumulated volume, growth speed, good bonding property, adaptability to poor land can be fully utilized.

Namely, the larch which had heretofore been used only as temporary scaffolding lumber for civil engineering work, supports for trees and low value wood such as pulp material can be put to diversified utilization such as in high quality decorating woods such as alcove posts, rafters, and also as the optimum wood for major structural uses as in wood frames, in construction of houses e.g. as square studs in heartwoods, headers, collar frames, rafters, lumber joists, collective studs, and also as decorative construction materials e.g. for high quality furniture wood, toy wood, floors, and walls.

Following is a description by way of example only of methods of carrying the invention into effect.

EXAMPLE 1

Treatment of log of a species having relatively large defects (representative species; beech, oak, larch, hemlock).

Birch log with bark whose moisture content was above 60%, and whose central diameter was 15 cm, and length was 4 m was placed in a boiling tank whose depth was 2 meters and width and length are 6 meters, and then it was boiled for about 12 hours with hot water containing the surface active agent whose temperatures was 92°-98° C. (aqueous solution of anion active agent having high permeation, dispersion, cleaning and solubility), and the boiled log was immediately placed in a pressure boiler whose diameter was 1.5 meter and length was 6 meters, and then aqueous solution concentration 0.1% of the surface active agent (anion active agent sodium dodecylbenzene sulfonate was economical) and dilute alkali solution (soda ash = $Na_2CO_3$ was suitable for practical purposes) having alkali aqueous solution concentration 4% were added until a volume equal to or more than the volume of the log was present and the log was treated for 3 hours under a temperature of about 130° C. and pressure of 3 kg/cm$^2$, and then the solution was drained. After the draining, the log having a moisture content of 28% 32% was subjected to reduced pressure dehydration until it reached the fiber saturation point. The reduced pressure was up to 500 mm mercury column pressure. The log was removed from the pressure boiler, and was then immediately subjected to kiln drying for more than 48 hours at a temperature of 55° C. ±5° C. After the kiln drying, the moisture content was below 10%. After removal of the log from the pressure boiler, the log was subjected to air drying for 10-15 days, and the moisture content became below 10%. After removal of the log from the pressure boiler, the log was subjected to the air dry for 10-15 days, and then was subjected to kiln drying for more than 24 hours at temperature of 55° C. ±5° C., and the same result was obtained.

As described in the foregoing, when the log which had been treated and dried was used as is, or was utilized as a board or square after being sawed and there were almost no defects.

EXAMPLE 2

Treatment of lumber of species having relatively large number of defects (representative species: beech, oak, larch, hemlock).

The lumber (2 × 4 inch sawed lumber for wood frame construction) whose moisture content was above 30% and below 60% and thickness is 44 mm and width was 94 mm and length was 3,640 mm was placed in a boiling tank whose depth is 2 meters and width and length are both 4 meters, and it was boiled for 8 hours in hot water and containing aqueous solution concentration 0.3% of the surface active agent whose temperature is 92°-98° C., and was shifted immediately to a pressure boiler whose diameter was 1.5 meter and length was 6 meters which was separately prepared, and it was treated for 2 hours in 2 kg/cm$^2$ pressure and 120° C. in the presence of an 0.05% aqueous solution of surface active agent, 0.2% aqueous solution of soda ash, and then the solution was drained. The surface active agent used was similar to the agent used in the Example 1. After the draining, the reduced pressure dehydration was effected until the moisture content of the sawed lumber about reached the fiber saturation point (28%-32%), and the sawed lumber was removed from the pressure boiler and was left in an indoor location where good ventilation was provided for several days so that the sawed lumber was air dried. The sawed lumber which had been subjected to the pressure treatment and air drying had almost no defects when is used as it was, or when it was used after effecting kiln drying to obtain a low moisture content of below 10% by the condition of 55° C. ±5° C.

The hemlock wood obtained according to the Example 2 did had almost no defects as a result of the treatment of the present invention and the untreated conventional wood had a low yield because of the large number defects resulting from drying of the defective lumber, e.g. compression wood, knots, bark pockets resin pockets, heartwood or sapwood or mixed lumber of heartwood and sapwood, and therefore it became possible to effect rationalization of about 20% of yield of sawed lumber and of about 50% of lumber sawing expenses. Also heretofore, the utilization of the compression wood which had not been heretofore utilized because of the defective material became used, whereby the added value increase of about 15% was recognized, and the economy could be improved greatly.

Incidentally it should be noted that 2 × 4 inch lumber (40 mm × 90 mm) drops sharply to the moisture content of average by only the air dry for several days and handling of the wood e.g. dry lumber of below 19%, which is the condition of the kiln dried wood, becomes possible.

EXAMPLE 3

Treatment of a thin plate of species having a relatively large number of defects (representative species: beech, oak, larch, hemlock, *Dysoxylum caulostachyum, Tarrietia simplicifalia, Koompassia malaccensis,* ebony, black ebony, rosewood).

The rosewood thin plate wood (note: furniture wood) whose moisture content was below 30% and thickness was 20 mm and width was 250 mm and length was 1,000 mm was plated in a boiling tank whose depth is 2 meters and width and length were both 4 meters, and was boiled for 4 hours by hot water containing aqueous solution of surface active agent having 0.5% concentration whose temperature was 92° C. to 98° C., and was transferred immediately to a pressure boiler whose diameter was 500 mm and length was 2 meters, and was treated for 2 hours in 2 kg/cm$^2$ pressure and 120° C. heating conditions by 0.1% aqueous solution of surface active agent and 0.2% aqueous solution of soda ash and the solution was drained.

After the draining, the reduced pressure dehydration was effected to a degree that the moisture content of the thin plate reached the fiber saturation point, and the thin plate was removed from the pressure boiler, and was subjected immediately to the kiln drying for more than 48 hours at 55° C. ±5° C., and consequently, almost the same result was obtained.

The rosewood according to the Example 3 did not contain spiral grain, warp, crook, or season cracks which are specific to the hardwood (yield of the wood improved by 20% on the average by the treatment), and also, since resin in the wood was properly effused, and the bonding of a pair of pieces was homogeneous and was extremely good and when it was processed to the furniture wood, there occurred almost no coating irregularity. Furthermore, bonding property was improved by 20–30% as compared with the untreated wood, and consequently the machining became easy.

Moreover, the surface hardness became improved by 15–25% as compared with the untreated wood, whereby the treated wood could be appreciated as good high quality furniture wood.

EXAMPLE 4

Treatment of lumber of species containing relatively large amount of resin and having large number of defects (representative species: larch, pine, douglas fir, *Dipterocarpus grandiflorus, Dryobalanops aromatica*).

The douglas fir lumber (note: door frame and molding) whose moisture content was above 30% and below 60% and its thickness 35 mm and width was 300 mm and length 2 meters was placed in a boiling tank whose depth was 2 meters and width and length were both 4 meters, and was boiled for 4 hours in hot water of 0.3% concentration of surface active agent, whose temperature was 92°–98° C., and the lumber was transferred immediately to a pressure boiler whose diameter was 500 mm and length was 2 meters which was prepared separately, and was treated for 2 hours under 2 kg/cm$^2$ pressure and 120° C. in 0.1% aqueous solution of surface active agent and 0.2% aqueous solution of soda ash, and the solution was drained. After the draining, the reduced pressure dehydration was effected until the moisture content of the lumber reached the fiber saturation point, and the lumber was carried from the pressure boiler and was subjected to air drying for more than 24 hours at a temperature of 55° C. ±5° C. to make the moisture content below 10%. After with drawing the lumber from the pressure boiler, the lumber was subjected to air drying for 5–7 days and was subjected for kiln drying for more than 24 hours at the temperature of 55° C. ±5° C., and the almost the same result was obtained.

The douglas fir according to the Example 4 was such that much resin was present and yet was maldistributed in the lumber, and therefore, in conventional boiling and drying treatments, it was difficult to eliminate the resin homogeneously to such a degree that it did not pose troubles in the utilization of the wood. For this reason, many and various efforts had been made by jointly using air drying kiln drying and boiling for a long time, but up to now the special features of the douglas fir were not fully utilized.

However, by this treatment, the excessive or maldistributed resin in the wood was completely effused, and the remaining resin was homogenized in the wood to a proper degree and therefore defects in the wood and also the surface permeation of resin resulting from the presence of resin are not generated at all.

Also, it was found that the wood can be obtained which is capable of preventing age change of the wood color which is a large defect in the utilization of the douglas fir.

As a result, it is now possible to effectively employ the douglas fir of specific grain, wood color or proper hardness in doors, windows or furniture.

Incidentally, the resin flowed out due to the pressure heating treatment by the aqueous solution of surface active agent and aqueous solution of soda ash in the pressure boiler and the evaporated resin was recovered and liquefied and turpentine oil was extracted, and the prevention of the defects in douglas fir, and prevention of resin effusion and prevention of change of wood color, due to age and turpentine oil recovery could be obtained by the treatment according to the present invention, and it was found that the present invention had large effects in the quality and economy with respect to the foregoing four phases.

EXAMPLE 5

Treatment of sapwood or heartwood whose color and shape are unsightly as well as having many defects (representative species: beech, monkeypot, walnut, rosewood).

Beech wood (note: for furniture) whose moisture content was above 30% and below 60% and thickness was 20 mm and width 150 mm and length 2 meters was placed in a boiling tank whose length was 2 meters and both width and length are 4 meters, and was boiled for 4 hours by hot water of 0.3% concentration surface active agent whose temperature was 92°–98° C., and was immediately transferred to a separately prepared pressure boiler whose diameter is 500 mm and length is 2 meters, and an amount of previously prepared 0.03% aqueous solution of brown red pigment was charged into a mixed solution of 0.1% aqueous solution of surface active agent and 0.2% aqueous solution of soda ash and the mixture was stirred so that the beech wood was colored into a false heartwood color or birch wood color which is the darkest color among the beech wood colors, and the wood was treated for 2 hours in 2 kg/cm$^2$ pressure and 120° C., and the solution was drained. After the draining, the reduced pressure dehydration was effected until the moisture content of the wood about reached the fiber saturation point, and the wood was transferred from the pressure boiler, and was immediately subjected to kiln drying for more than 24 hours at the temperature of 55° C. ±5° C. and the moisture content was below 10%.

The beech wood before being treated by the Example 5 is extremely defective wood and the irregular pattern of dark brown of the false heartwood greatly deteriorates the commercial value of the wood. However, by the treatment according to the present invention, the defects were eliminated, and the entire piece of wood was colored false heartwood color or birch wood color, and when the wood was subjected to resawing, cutting or boring, the whole piece of wood was finished with a uniform wood color and the commodity value was highly improved. Also, by this treatment, the coating was finished with stabilized homogeneity, and numerous effects were obtained such as the improved bonding property and surface hardness.

As clearly described in the foregoing examples, the treatment according to the present invention, provides an improvement in the quality and economical use of wood.

Typical advantages are:

(1) Without discrimination of softwood and hardwood, this invention can be applicable to all the species in the world, and significant improvements in quality can be noted. Hence an enormous volume of hitherto unutilizable wood which has not been utilized conventionally on account of defects and effusion of resin can now be properly utilized.

(2) This invention can be applied to the wood of all shapes such as round wood, thick planks and thin planks, and sufficient effects can be respectively rendered.

(3) Even if the moisture content of the treating wood is great and is unstable, it can be changed to a wood having uniform quality to a certain object.

(4) By reduced pressure treatment of the wood to make the moisture content reach a fiber saturable point after pressure and heating treatment in the pressure boiler, the kiln drying can be applied to the wood in high temperature condition, eliminating the generation of defects by the air drying and saving the trouble of drying and producing the desired wood which is suitable for uses such as moisture content of less than 10% and is capable of preventing agent change of wood color and flowing of resin and preventing defects, in a short period of 2–4 days from the original wood to the commodity.

By the method of the present invention, extremely great economic effects can be obtained such as reduction of yield loss due to damage during storage of the wood and the reduced interest, improvement of revolving rate of funds, production capable of corresponding to an abrupt change of market, and establishment of shipping system.

(5) Since almost there are no defects in wood such as sapwood heartwood, sapwood and heartwood mixed wood, reaction wood, elimination of knots, bark pockets, resin pockets and partial excessiveness of wood structure parenchyma such as hemicellulose, lignin and defects such as crooks, warps, spiral grains, breaks in the maldistributed portion, which cause wood quality differences and, which tend to become causes of defects in wood, result in great improvements in yield and additional value.

(6) The treated wood can be subjected to complicated machining, grooving, boring, etc., and even if the wood is preserved for a long period, there would be almost no defects, and therefore, such wood can be used for goods of unsteady demand which are required to have high quality, such as molding, furniture wood and door and window wood.

(7) The treated wood becomes of the alkaline type and is resistant to discoloring bacteria and corroding bacteria, and an anticorroding effect and a moth proofing effect is automatically obtained, and thus the utilization range and added value of the wood are further increased.

(8) Low value woods such as larch can be used as the high quality decorating wood in situations such as alcove posts, rafters, polished logs, and may also be employed for machined angular columns and decorated angular columns.

Also, the wood can be utilized in many other ways such a structural wood e.g. square studs in heartwood, rafters, collar beams, lumber joists, and also as high quality furniture wood, toy wood, collective stud and decorative structural wood.

(9) Larch is well known, not only in Japan, but also in the world as species having a number of defects and a technology for preventing defects in larch has been strongly demanded, and the enormous volume worldwide and speed of growth indicate that a considerable surplus could result. Accordingly, the present invention can utilize larch which at the moment is little used, and it is easy to obtain in such uses for high class wood at economical price, and also makes extremely effective utilization possible from the standpoint of world resource policy.

(10) As few defects result even if square sawing is not carried out, plain sawing or round sawing can be employed and a 20% improvement in the reduction of sawing costs and yield of sawing can be obtained as compared with plain sawing. (Yield of original plain sawed lumber in case of the larch is 60–65% and yield of original of round sawn lumber is 80–85% which is the average actual value.)

(11) By the treatment for prevention of defects, its bonding power is improved by 10–30% as compared with untreated wood.

(12) Bonding power of paint is improved and homogeneity of coating is obtained.

(13) Cutting and polishing properties have been improved, and consumption of cutting materials such as sanding paper has been greatly reduced.

(14) Small width plank or short length wood which generally become rejects can be used as lumber core or collecting wood of the excellent quality, which does not have defects at all, and the added value can be greatly improved.

(15) Hemlock which is main species of molding in Japan is mostly reaction wood and therefore utilization yield is considerably reduced; the basic cause of defects cannot be corrected by the conventional technology such as a steaming process, but treatment in accordance with the present invention can produce a frame wood of excellent quality and as a result, the yield can be improved by more than 20%.

(16) Turpentine oil can be extracted from resin evaporated from resin which is obtained from the process of the present invention.

(17) Since the surface hardness of the treated wood improves by 15–25%, (1) relatively soft wood can be utilized as hard wood such as for table wood, furniture wood, and (2) efficient utilization of woods such as poplar, eucalyptus can be obtained, which woods grow fast but which have not hitherto been suitable for general use because they are too soft.

All percentages in the specification and the claims are expressed as percentages by weight.

What is claimed is:

1. A process for treating wood comprising:

(1) contacting the wood with a hot solution containing 0.1 to 0.5% of anionic surface active agent at 92° to 98° C. for 4 to 12 hours;

(2) immediately thereafter contacting the wood treated in (1) with a solution containing 0.05 to 0.1% of anionic surface active agent and 0.2 to 0.4% of soda ash, in a pressure boiler for 2 to 3 hours at a temperature of 120° to 130° C. and a pressure of 2 to 3 $kg/cm^2$;

(3) draining the solution from said pressure boiler and then subjecting the thus treated wood to vacuum of up to 500 mm/hg and dehydrating it until the moisture content of the wood reaches the fiber saturation point of 28 to 32%; and (4) drying the wood.

2. The process as claimed in claim 1 wherein the anionic surface active agent is sodium dodecyl benzene sulfonate.

3. The process as claimed in claim 1 wherein coloring is added to the solution of (2) whereby the treated wood has imparted thereto a desired color.

4. The process as claimed in claim 1 wherein the wood is sawed hemlock.

5. The process as claimed in claim 4 wherein the hemlock has a large number of defects, the surface active agent is present in the solution of (1) at a concentration of 0.5% and the treatment of (1) is performed for 8 hours.

6. A process for treating wood as claimed in claim 1 wherein the wood is one or more of beech oak, larch, pine, hemlock, *Dysoxylum caulostachyum, Tarrietia simplicifalia, Koompassia malaccensis,* ebony, black ebony, rosewood, douglass fir, *Dipterocarpus grandiflorus, Dryobalanops aromatica,* monkeypot, walnut.

* * * * *